United States Patent [19]

Lewis, Jr.

[11] Patent Number: 4,607,411

[45] Date of Patent: Aug. 26, 1986

[54] MOLDED BRUSH BLOCK WITH INTEGRAL SQUEEGEE

[75] Inventor: John C. Lewis, Jr., Forest Dale, Vt.

[73] Assignee: Tucel Industries, Inc., Forest Dale, Vt.

[21] Appl. No.: 706,957

[22] Filed: Feb. 28, 1985

[51] Int. Cl.[4] ..... A47L 13/11; A47L 13/12

[52] U.S. Cl. ..... 15/117; 15/245

[58] Field of Search ..... 15/117, 245, 401

[56] References Cited

U.S. PATENT DOCUMENTS

| | | | |
|---|---|---|---|
| 1,215,239 | 2/1917 | Bayless | 15/117 |
| 1,591,565 | 7/1926 | Schaffert | 15/117 |
| 1,818,917 | 8/1931 | Wolf | 15/117 X |
| 1,853,715 | 4/1932 | Anderson | 15/245 X |
| 2,739,338 | 3/1956 | Weeks | 15/245 |
| 3,119,138 | 1/1964 | Davis | 15/245 X |
| 4,381,575 | 5/1983 | Wendt | 15/245 X |

*Primary Examiner*—Chris K. Moore

*Attorney, Agent, or Firm*—Lowe, Price, LeBlanc Becker & Shur

[57] ABSTRACT

A combination push-type broom and squeegee blade constructed from a molded thermoplastic block is disclosed. The device is suitable for both sweeping and applications of surfacing materials such as driveway coater chemicals. The brush block consists of a thermoplastic molded block having an integral squeegee blade. The blade is molded in a predetermined cross-section and interconnected with the block by an integral thermoplastic, thin hinge connector. Pivot stops are provided on the blade so that the blade will pivot a predetermined arc relative to the brush block. Tufts may be mounted in the conventional fashion on an opposite face of the brush block. The brush block further includes a conventional handle to form the push broom coater device of this invention.

8 Claims, 11 Drawing Figures

103"
107
104
105
102
106
103'
107
4
4
103
100
102
101

107'
108"
102
108'
106
107'
104
108
100
102
101

MOLDED BRUSH BLOCK WITH INTEGRAL SQUEEGEE

This invention relates to a brush block such as used to construct a push broom with a squeegee attachment particularly suited for sweeping and/or resurfacing with liquid-type resurfacing agents such as driveway coater chemicals. This invention relates specifically to a novel device for mounting brush tufts which includes an integral squeegee blade.

For the most part, prior to the instant invention, push brooms and squeegee coaters were normally constructed from a wooden or plastic block with a separate rubber or vinyl squeegee blade attached. In order to assemble this type of product, tufts such as tufts of synthetic filaments are assembled on the brush back and then a squeegee blade is physically added. The blade normally would be stapled onto the block at a predetermined angle or, if the block is plastic, the rubber or vinyl squeege blade could be molded into the block itself. It was not possible to mold a projection integral with a plastic block, because the projection would not act as a squeegee blade. It would be a non-pivoting stiff pusher which would not function as a squeegee blade. The prior art then does not contain a means for producing a thin pivoting-type squeegee blade integral with a block of structural foam such as polypropylene structural foam or polystyrene structural foam with a flexibility which would permit pivotal movement of the squeegee blade in the range of 0.020 inches up to 0.100 inches.

It has been discovered, however, that a brush block of structural foam plastic may be formulated with an integral squeegee blade which will have sufficient flexibility and yet be sufficiently durable to function as a driveway coater or the like. The block of the instant invention is molded with a "living" hinge connection between the squeegee blade and the block itself which is sufficiently thin to insure flexibility. Pivot stops are also molded on the blade so that it will only pivot a predetermined distance. Accordingly, a push broom with squeegee attachment can be constructed then merely by tufting a premolded block and attaching a handle. The need for a vinyl or rubber blade and means for attaching the blade to a separate block then is eliminated by the instant invention.

Accordingly, it is an object of this invention to provide an improved push-type broom or squeegee coater brush construction which provides an integral pivoting blade.

It is another object of this invention to provide a driveway coater brush having an integral, structural foam squeegee blade mounted thereon which protrudes at an angle of between 60 and 120 degrees from the face portion thereof wherein the filament tufts are attached.

It is another object of this invention to provide a push-type patio or floor broom having an integrally connected structural foam squeegee blade which is constructed of polypropylene structural foam.

It is yet another object of this invention to provide a broom or coater block which can be easily molded from thermoplastic material and is durable, crack-resistant, chemically resistant, and sufficiently inexpensive to be a one-use applicator.

These and other objects will become readily apparent with reference to the drawings and following description wherein.

Figure 1:
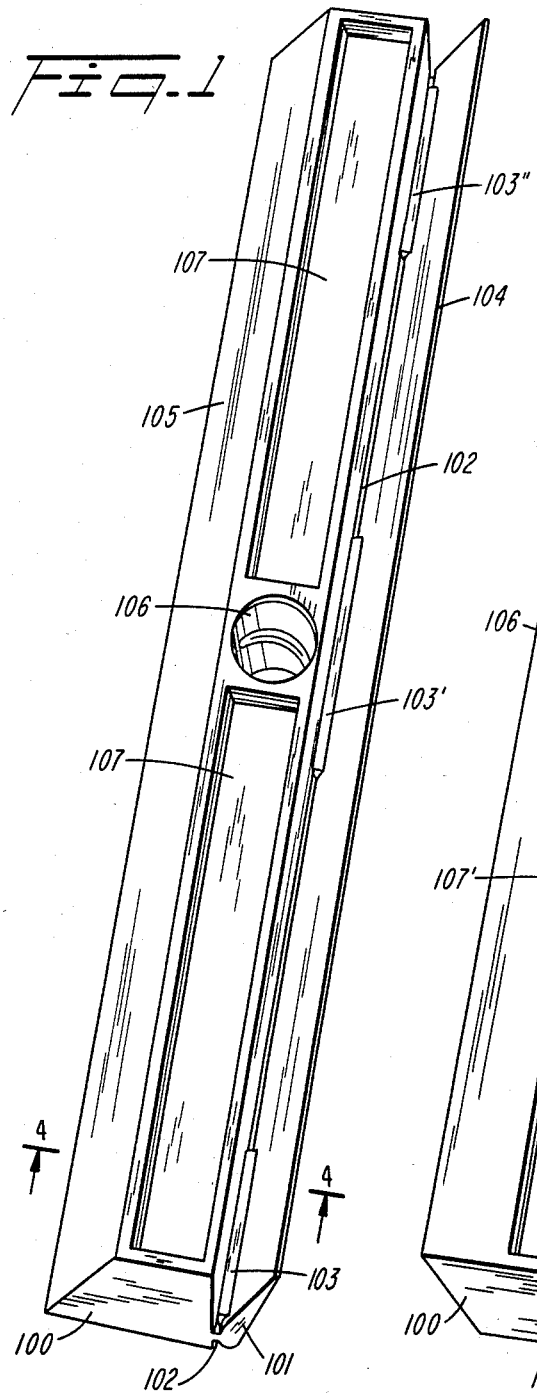
FIG. 1 is a perspective view of an applicator block according to the instant invention.

With reference to the drawings and to FIG. 1 in particular, the molded integrally connected pivotable blade 101 is shown in a teardrop shape with the blade 101 being integrally connected to a base block 100 through a connecting member identified as living hinge 102. The block in general can have various other features such as a tufted surface 105, depressions 107 in order to conserve raw material, and a threaded hole 106 for receiving the end of a handle (not shown). Surface 105 may mount a plurality of filament tufts affixed thereto by any conventional means or by the method and apparatus disclosed in one or more of my prior patents, for example, U.S. Pat. No. Re. 27,455, U.S. Pat. Nos. 3,596,999, 3,604,043, 3,799,616 and 4,009,910.

Figure 2:
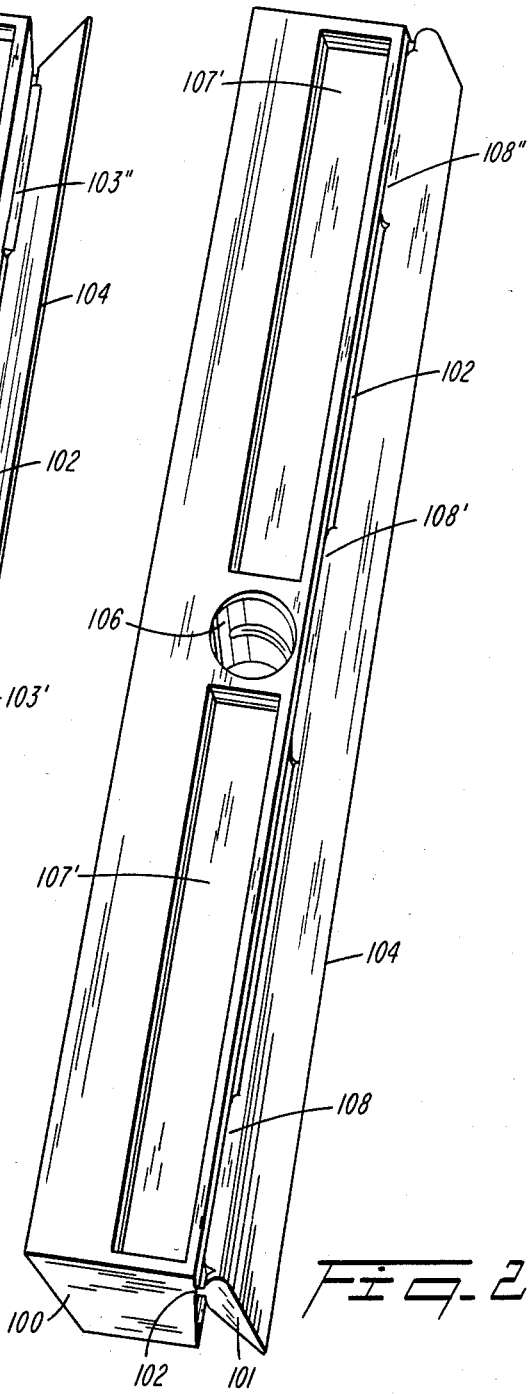
FIG. 2 is a perspective view of the applicator block of FIG. 1 as shown from the opposite side.
Figure 3:
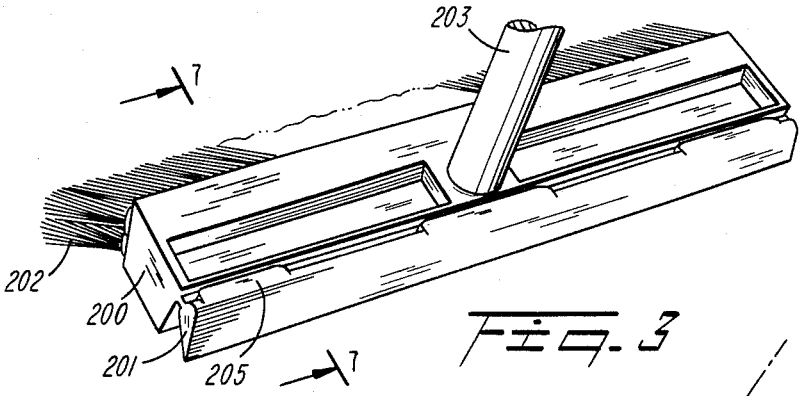
FIG. 3 is a perspective view of the block of FIG. 2 in brush form.

The teardrop shape of blade 101 gives the blade structure strength along its length while the working edge 104 thins down to a small edge on the order of 0.030 to 0.090 inches thick. Blade 101 has at least one stop member against pivotal rotation. Stop members 103, 103' and 103'' are shown in FIG. 1, while stop members 108, 108' and 108'' are shown in FIG. 2. Stop members are intended to stop pivotal movement of blade 101 relative to block 100 with integral living hinge 102.

While the size and position of the stops 103 and 108 are important, the integrally connected blade 101 and connector hinge 102 are the key elements in providing block 100 with a pivotable squeegee blade 101.

During structural foam molding, it is most important that a homogeneous bridge between block 100 and blade 101 be formed. This bridge or thin integral member 102 is sufficiently flexible to allow blade 101 to move through an arc between stops 103 and 108 during subsequent use as a squeegee. Thus, the thickness of connecting hinge 102 will dictate whether the pivotal movement of blade 101 is very flexible or very stiff.

Figure 4:
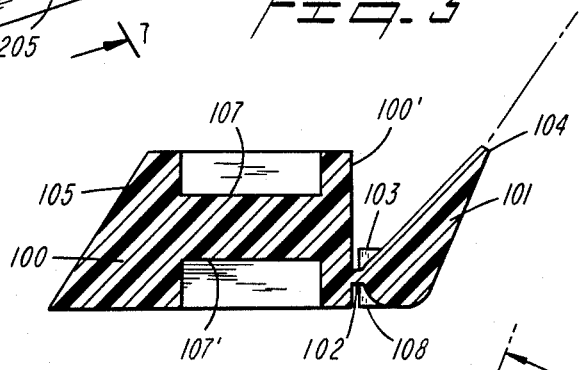
FIG. 4 is an enlarged sectional view taken substantially along Line 4—4 of FIG. 1 illustrating the pivotable, integrally connected blade section in the normal attitude.
Figure 5:
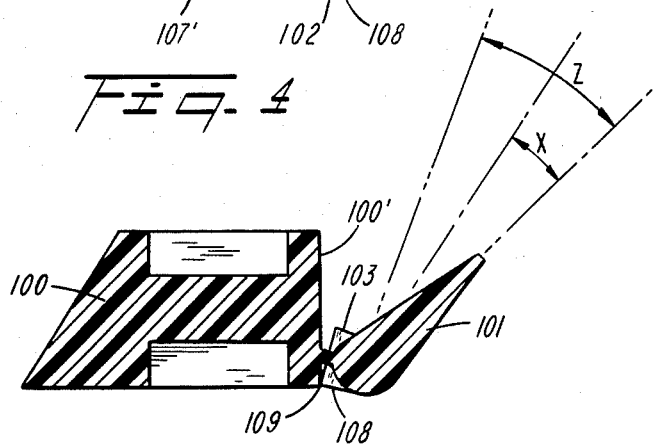
FIG. 5 is an enlarged sectional view similar to FIG. 4 illustrating the pivotable, integrally connected blade section in a flexed attitude.
Figure 6:
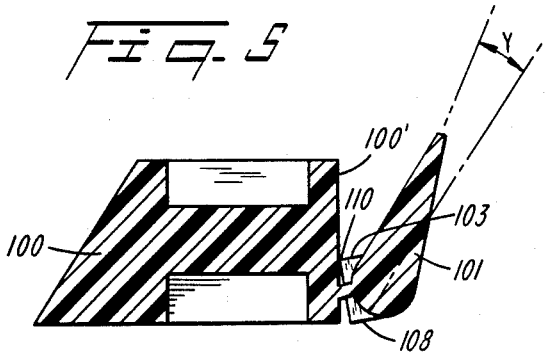
FIG. 6 is an enlarged sectional view similar to FIG. 5 illustrating the pivotable, integrally connected blade section also in a flexed attitude.

With attention to FIGS. 4–6, therein is illustrated the pivotal movement of blade 101. In FIG. 4, blade 101 is shown in its normal attitude whereby the blade 101 is angled equidistantly from an open position illustrated in FIG. 5 to a closed position illustrated in FIG. 6. Stops 103 and 108 are equidistant from the block surface 100' and separated from block 100 by the connecting hinge member 102.

As the pivotal blade 101 is moved through an arc "x" as illustrated in FIG. 5, stop 108 engages block surface 100' at point 109 and thereby stops further movement of blade 101. Likewise, as the pivotal blade 101 is moved through an arc "y", as illustrated in FIG. 6, the stop 103 engages block surface 101' at point 110. This engagement then stops further movement of blade 101. A total of "z" arc is created whereby pivotal blade 101 can move through a given angle in order to act as a squeegee member, thus duplicating the action of a conventional rubber or vinyl squeegee.

A preferred embodiment of this invention is illustrated in FIGS. 3, 7, 8 and 9. The driveway coater brush and squeegee 200 shown in FIG. 3 mounts brush tufts 202 attached to a side of the block 200 opposite the squeegee blade 201. Block 200 is fitted with a wooden handle 203 in the conventional fashion.

Figure 7:
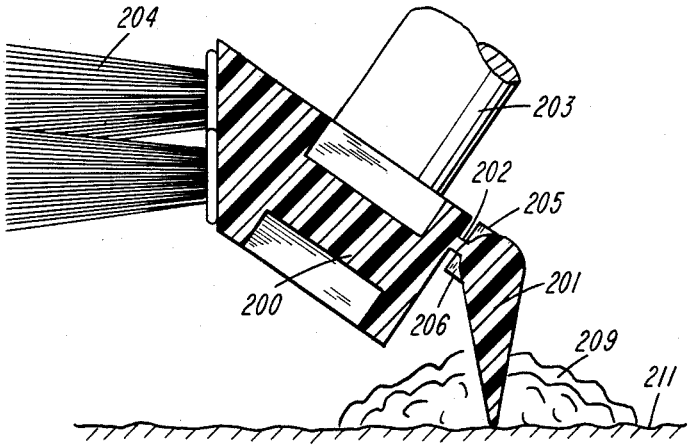
FIG. 7 is an enlarged sectional view taken substantially along Line 7—7 of FIG. 3 illustrating the pivotable, integrally connected blade section in normal attitude.

FIG. 7 illustrates the normal position of the squeegee blade 201 as it is in contact with coating material 209 on a driveway surface 211. In this position, the blade 201 is in an attitude whereby stops 205 and 206 are equidistant from the block 200 and blade 201 is integrally connected thereto through hinge member 202.

Figure 8:
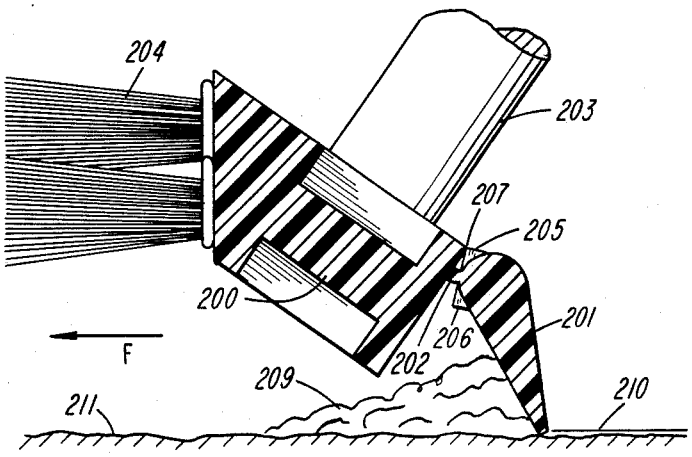
FIG. 8 is an enlarged sectional view similar to FIG. 7 illustrating the pivotable, integrally connected blade section in the flexed attitude of FIG. 5.
Figure 9:
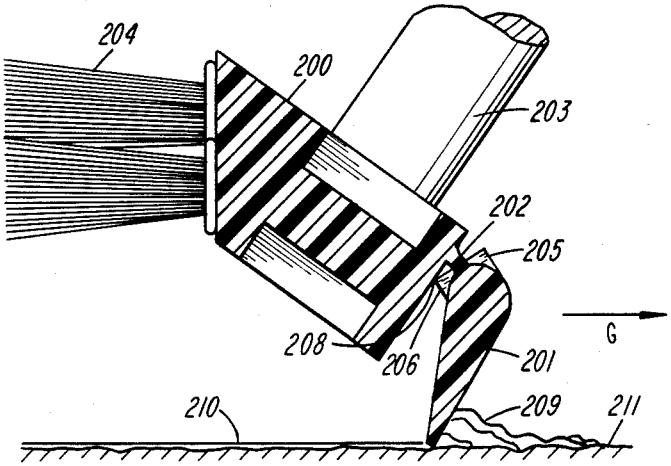
FIG. 9 is an enlarged sectional view similar to FIG. 8 illustrating the pivotable, integrally connected blade section in a flexed attitude similar to FIG. 6.

As force is applied in the direction F in FIG. 8, the squeegee blade 201 flips backward on members 202 and stop 205. Blade 201 then engages block 200 at point 207 to allow the squeegee member 201 to spread coating material 209 into a thin, continuous layer designated as 210 upon driveway surface 211.

As further pressure is applied in the reverse direction to block 200, in the direction G, the blade 201 flips in the opposite direction and allows the stop 206 to engage block 200 at point 208. This engagement allows the coating material 209 to be spread into a thin layer 210 back over itself to distribute the coating material in a more uniform manner. As this action is repeated in reverse directions, first in the direction F and then in the direction G, the blade 201 moves through an arc of up to 90 degrees. The coater brush/squeegee unit then resurfaces the driveway in a conventional fashion. Blade 201 acts in an identical fashion to separately applied rubber or vinyl blades in a conventional coater brush unit. The difference, however, is that the integral blade 201 is molded from the same material as block 200.

Figure 10:
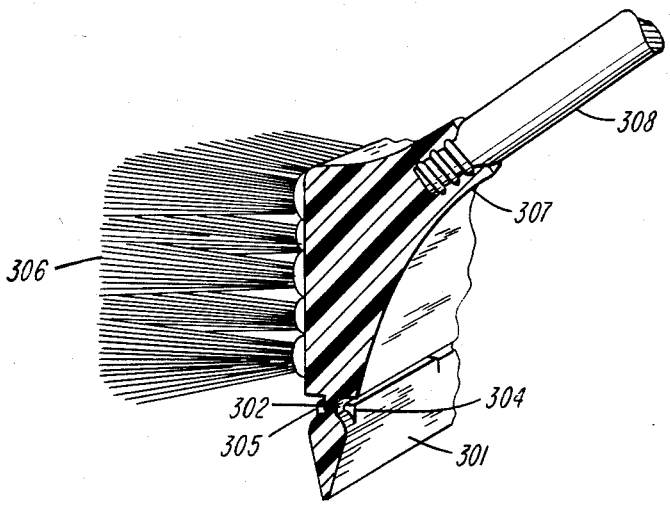
FIG. 10 is a fragmentary sectional isometric view of a push broom illustrating the pivotable, integrally connected blade section as it is molded onto a foam molded push broom block.

The same principle may be applied to push brooms as illustrated in FIG. 10 wherein a block 300 is tufted with filaments 306 and has an integral squeegee blade 301 attached through and by means of integrally molded hinge member 302. Blade 301 mounts stops 304 and 305. The broom has a threaded adapter 307 and handle means 308.

Figure 11:
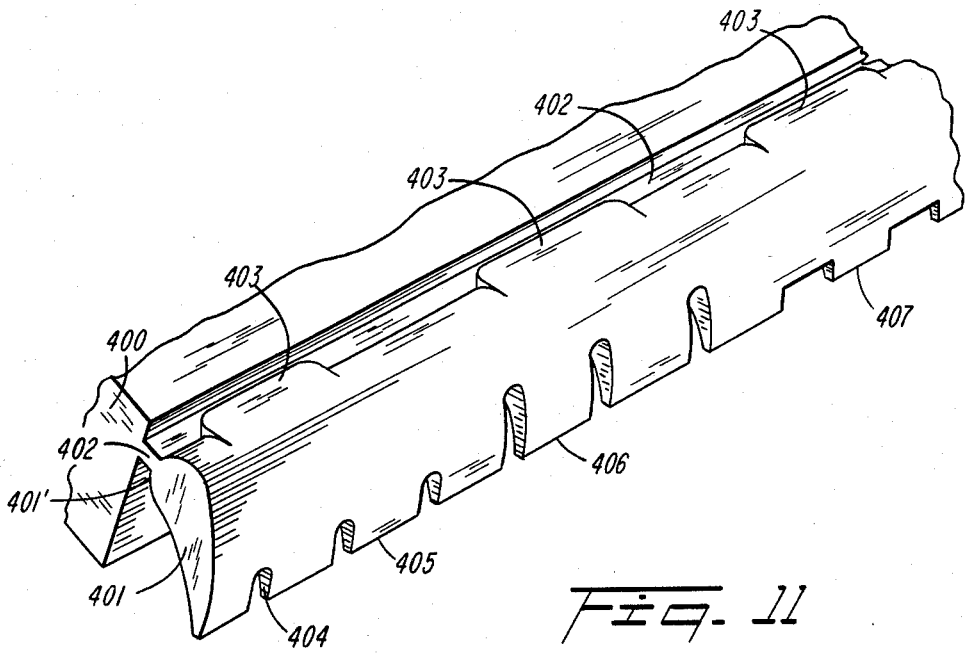
FIG. 11 is a partial perspective view of a foam molded pivotable blade of this invention illustrating various crenelated designs along the working edge of the blade.

The squeegee blade of the instant invention is not limited to the specific teardrop shape illustrated, for example, in FIG. 1, but may have various cross-sectional shapes as well as cutaway thin spreading members attached thereto as illustrated in FIG. 11 in sections 404, 405, 406 and 407. The blade 401 is attached to and integral with block 400 through member 402 and contains stop member 403. It is also possible to use edge 401' of blade 401 to act as a stop means on one side or the other of the blade.

It has been found that other shapes can be employed for the blade sections, and such shapes are not limited to teardrops, but may take the form of triangles, rectangles, circles, ovals and the like. The crucial feature of the instant invention is that the thin integral member between the blade and block must be of a thickness of not less than 0.010 inches and not more than 0.090 inches.

The resins used for manufacturing and molding may be taken from the group consisting of polypropylene, copolymers, polyethylene and polyurethane. Also, the instant invention is not limited to structural foam molding, but can be practiced with conventional injection molding techniques.

In summary, the push-type broom and applicator molded thermoplastic block of the instant invention comprises a broom or brush block of generally oblong configuration having at least three elements. The three elements are a main block section, a pivotable squeegee blade integrally connected thereto, and a handle or means for mounting a handle.

Two of these elements, the fiber or filament tufts and the handle, are standard in any brush or broom product. The pivotable, integrally connected squeegee blade element, however, is new and novel both to the molding process and to the brush or broom item.

The pivotable blade section is designed to flex through a specific arc as the block is indexed back and forth along a surface. By providing stop means preferably on the blade portion, the arc "z" can be controlled through a total angle of 120 degrees. The preferred arc, however, is between 25 and 40 degrees.

It is the ability of this pivotable blade to index first backwards approximately 15 to 20 degrees in arc "x" as the applicator is pushed forward, and then index forward by first returning to its median position of 0 degrees, and subsequently going through an additional 15 to 20 degrees in arc "y" as the applicator is indexed backward. This then provides a full arc "z" of some 25 to 40 degrees and allows the blade section to act in the same manner as a rubber or vinyl blade would if it had been mechanically fastened to the applicator. This results in a pivotable blade which will either smooth out or distribute a liquid material on a surface, or will act as a "pusher" with a liquid that is to be pushed away on a smooth surface.

It will be apparent to those skilled in the art of brush and broom manufacture that the elimination of fastening a rubber or vinyl squeegee mechanically to a broom or brush will save not only raw materials, but up to 70% of the labor and overhead charges as well as packaging and handling charges.

It will also be apparent to those skilled in the art of structural foam molding that the integral blade construction of this invention is an improvement over the prior art, including ease and economy of manufacture.

This invention may be embodied in other specific forms without departing from the spirit or essential characteristics thereof. The present embodiment is therefore to be considered in all respects as illustrative and not restrictive, and the scope of the invention is indicated by the appended claims rather than by the foregoing description. All changes which come within the meaning and range of equivalency of the claims are therefore intended to be embraced herein.

What is claimed and desired to be secured by Letters Patent is:

1. An integrally molded block and squeegee blade for use as a push broom and coater combination comprising:

a thermoplastic molded base block having a face thereon adapted to mount brush tufts to form a tufted surface on said face;

a blade member having a predetermined cross-section disposed along the length of said brush block;

integral hinge connector means connecting said blade member and said block along the length of said block for permitting pivotal movement of said blade member relative to said block;

stop means mounted on said blade member for engaging said block so that when said blade member pivots relative to said block it will pivot through a predetermined arc until said stop means engages said block against further pivotal movement; and means for mounting a handle on said block.

2. The device of claim 1 wherein said blade member is teardropped in cross-section with a maximum thickness adjacent said block with a minimum thickness at the trailing edge of said blade member.

3. The device of claim 1 wherein said hinge means has a thickness of from 0.010 inches to 0.090 inches.

4. The device of claim 1 wherein said block, integral hinge means and blade member are molded from the group consisting of polypropylene, copolymers, polyethylene and polyurethane.

5. The device of claim 1 wherein said block, integral hinge means and blade member are molded from the group consisting of polypropylene structural foam or polystyrene structural foam.

6. The device of claim 1 wherein said stop means permits pivotal rotation of said blade member through an arc of about 120 degrees.

7. The device of claim 1 wherein said stop means permits pivotal rotation of said blade member through an arc of from 25 to 40 degrees.

8. The device of claim 1 wherein said stop means includes integral projections disposed on said blade member adjacent said connector means.

* * * * *